US012213580B2

(12) United States Patent
Pyle

(10) Patent No.: US 12,213,580 B2
(45) Date of Patent: Feb. 4, 2025

(54) POCKET TOOL HOLDER

(71) Applicant: Terry Pyle, Globe, AZ (US)

(72) Inventor: Terry Pyle, Globe, AZ (US)

( * ) Notice: Subject to any disclaimer, the term of this patent is extended or adjusted under 35 U.S.C. 154(b) by 0 days.

(21) Appl. No.: 18/304,833

(22) Filed: Apr. 21, 2023

(65) Prior Publication Data

US 2023/0397711 A1 Dec. 14, 2023

Related U.S. Application Data

(60) Provisional application No. 63/351,453, filed on Jun. 13, 2022.

(51) Int. Cl.
*A45F 5/00* (2006.01)
*A45F 5/02* (2006.01)

(52) U.S. Cl.
CPC ..... *A45F 5/022* (2013.01); *Y10T 24/1376* (2015.01)

(58) Field of Classification Search
CPC . A45F 5/02; A45F 5/022; A45C 11/34; B43K 23/001; Y10T 24/1376; Y10T 24/1335
See application file for complete search history.

(56) References Cited

U.S. PATENT DOCUMENTS 1,110,518 A * 9/1914 Werner ..... B43K 23/001 24/135 R
1,401,809 A * 12/1921 Morin ..... B43K 23/001 24/339
3,564,668 A * 2/1971 Kirk ..... B43K 23/001 D8/395
4,391,457 A * 7/1983 Gassner ..... B42D 3/12 281/31
5,718,023 A * 2/1998 Billish ..... A45F 5/02 24/336
6,659,321 B2 * 12/2003 Hartranft ..... B25H 3/00 224/230
9,198,498 B2 * 12/2015 Stevens, IV ..... F41C 33/0209
10,842,251 B1 * 11/2020 McMillan, II ..... A45C 13/005
2002/0113107 A1 * 8/2002 Hartranft ..... B25H 3/00 224/904
2006/0282989 A1 * 12/2006 Dietz ..... B43K 25/02 24/10 R
2019/0053612 A1 * 2/2019 Santini ..... A45F 5/02

FOREIGN PATENT DOCUMENTS

EP 3162247 A1 * 5/2017

* cited by examiner

*Primary Examiner* — Robert Sandy
*Assistant Examiner* — Michael S Lee
(74) *Attorney, Agent, or Firm* — SHUTTLEWORTH & INGERSOLL, PLC; Brett D. Papendick

(57) ABSTRACT

A tool holder device that holds a plurality of tools. The device is insertable into a pocket of clothing. Connecting members of the device are relative to certain sides of the device such that the weight of the tools is transferred to a side of the device. As such, the clothing of a user bears less weight and is less susceptible damage.

2 Claims, 3 Drawing Sheets

POCKET TOOL HOLDER

CROSS-REFERENCE TO RELATED APPLICATIONS

The present application claims priority to provisional patent application 63/351,453 which was filed on Jun. 13, 2022, and is hereby expressly incorporated by reference in its entirety.

BACKGROUND

In utilizing common hand tools for various projects, a person is assisted by having devices that can hold a variety of tools. The types of tools are dictated by the particular job being performed by the person. There are a variety of devices that are attachable to a person for holding tools. Devices that are meant to attach to clothing can damage the clothing, in particular pockets of the clothing.

It is an object of the present invention to have the ability to hold a plurality of tools while mitigating the damage to clothing.

SUMMARY OF THE INVENTION

The current invention is a device that can be fitted into a pocket of a user to hold a plurality of hand tools. A main body of the device has a first compartment that is selectively attachable to the clothing of a user of the device. An extension member extends from the main body and comprises at least one and preferably a plurality of additional compartments for holding additional tools such as hammers, screwdrivers, plyers, etc.

The main body utilizes side walls to spread the forces created by the device and any tools held within the device over the back wall and other areas of the device. As the force is spread out over a larger area than the current state of the art, there is less damage to clothing.

DETAILED DESCRIPTION

Figure 1:
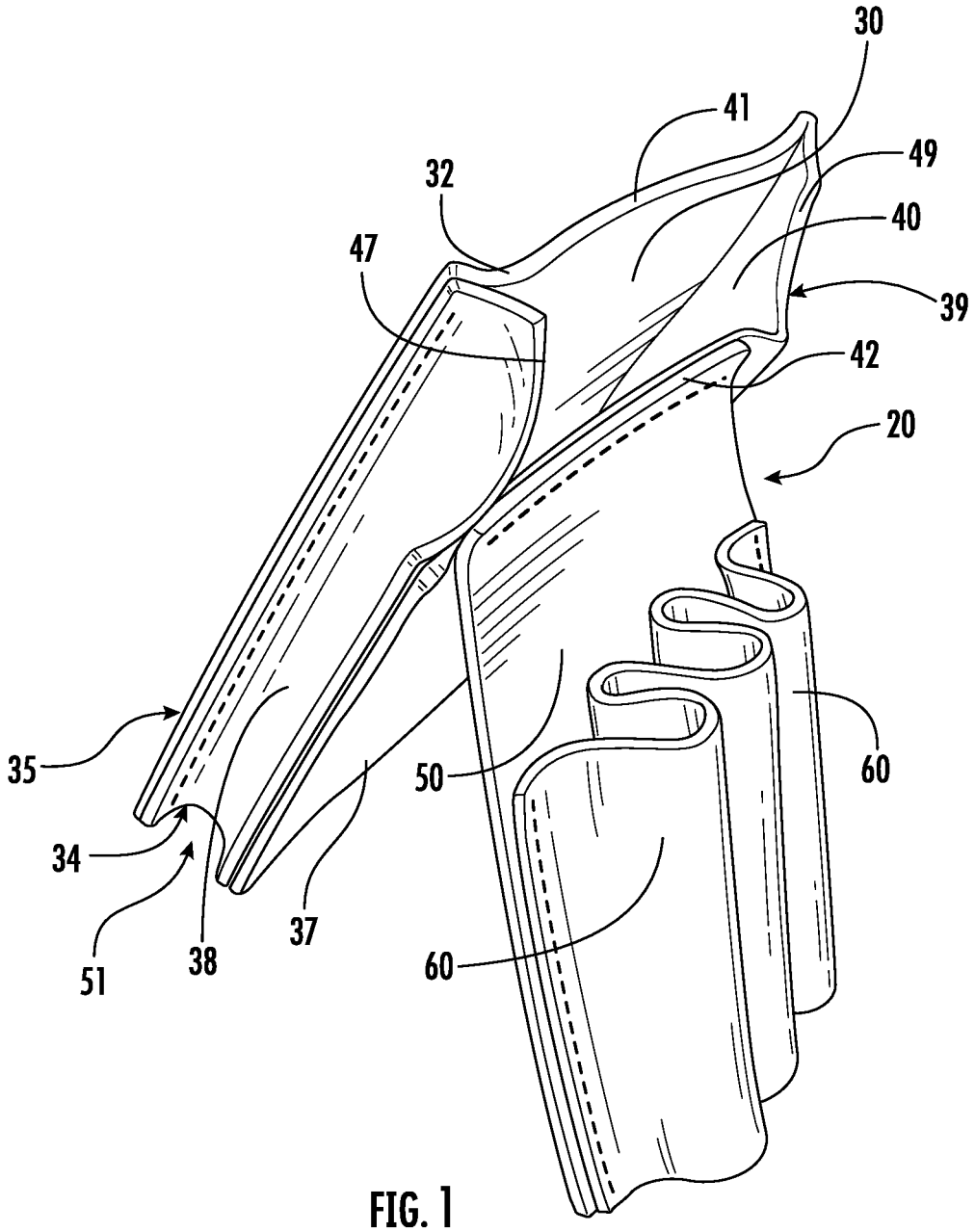
FIG. 1 is a perspective view of the tool holder.
Figure 2:
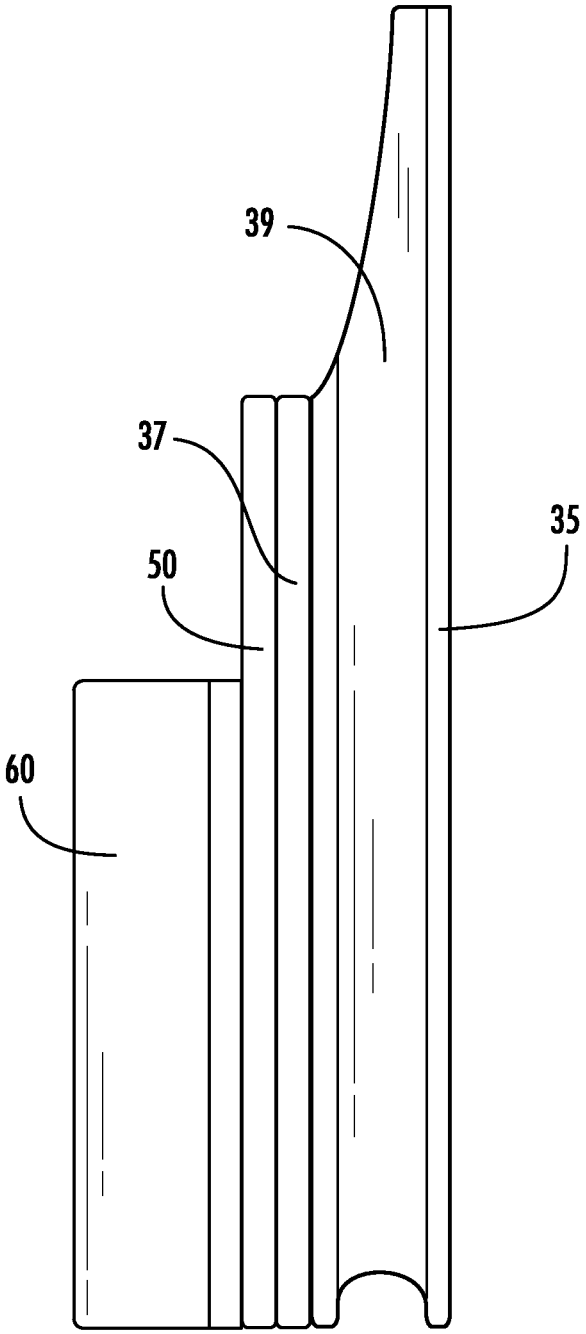
FIG. 2 is a side view of the tool holder.
Figure 3:
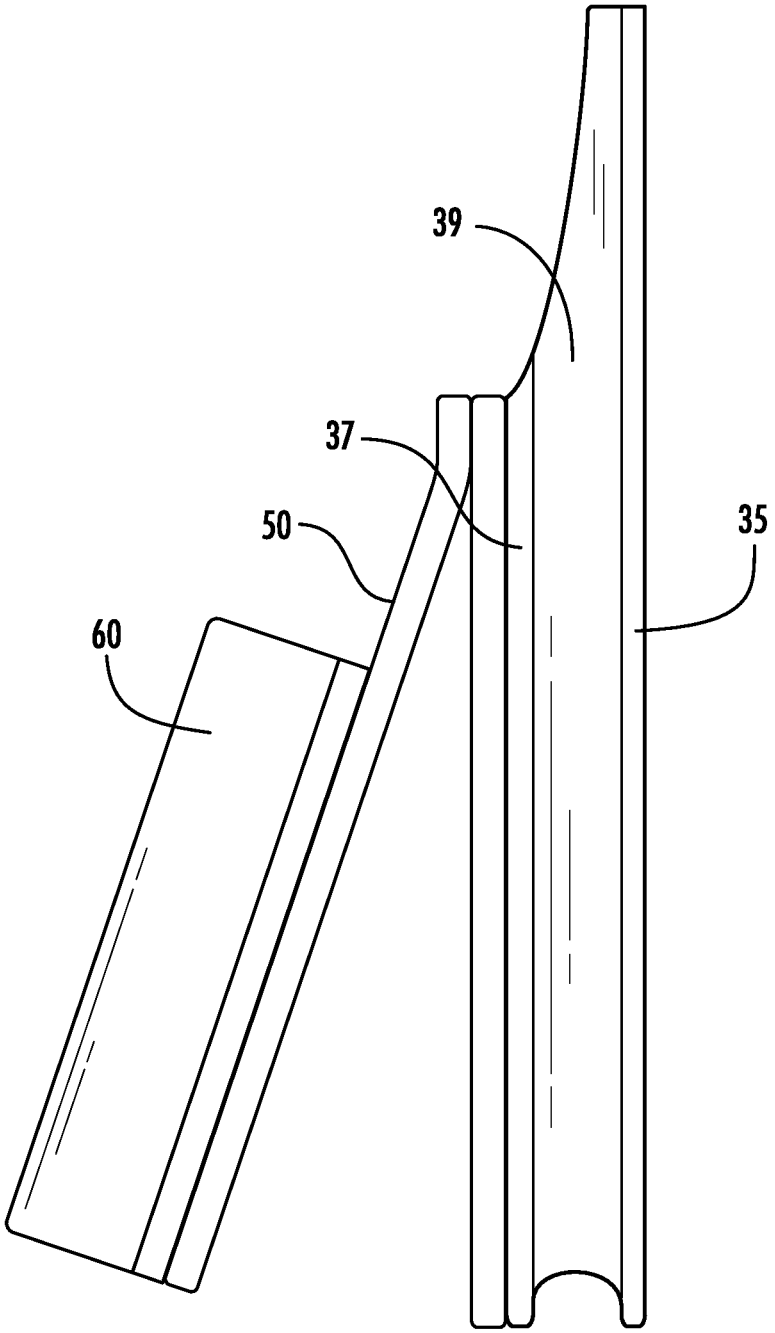
FIG. 3 is a second side view of the tool holder.

Now referring to the drawings, FIGS. 1-3 show a tool holder device 20. The device 20 has a main body 30. The main body 30 preferably comprises certain sides, connecting members and/or walls that form a compartment 40 of the main body 30. The compartment 40 can accommodate one or more tools, however, the functionality of the main body 30 is shifting the force exerted by weight of the device 20, and more importantly the weight of the tools held in the device 20, from a user's clothing to the main body 30.

In the preferred embodiment, the main body 30 has a first end 32, a second end 34, a first side 35, a second side 37, a first connecting member 38 and a second connecting member 39. A bottom wall 51 can be utilized as well to define the compartment 40. The first side 35 and the second side 37 can be wider at the first end 32 than at the second end 34. Accordingly, this allows tapering towards the second end 34 which allows the device 20 to fit in a user's pocket more efficiently that if the same width was utilized.

Furthermore, the first side 35 of the main body 30 is preferably longer than the second side 37 of the main body 30. A first connecting member 38 connects the first side 35 to the second side 37. Preferably, the first connecting member 38 forms a side wall of the main body 30. As the first side 35 is longer than the second side 37, the top 47 of the first connecting member 38 slopes downward toward the second side 37. The preferred embodiment has the first connecting member 38 which is connected at a top 41 of the first side 35 and also connected to a top 42 of the second side. A second connecting member 39 with a top 49 and is similar to the first connecting member 38, but is on the opposite side of the main body 30, as shown in FIG. 1.

An extension member 50 extends from the main body 30. The extension member 50 comprises at least one compartment 60 and preferably a plurality of compartments 60 for holding additional tools. The extension member 50 is preferably attached to the second side 37 at or near the top 42 of the second side 37. Once the device 20 is placed in a user's clothing pocket, the weight of the device 20 and tools exert a force near the top 42 of the second side 37, which in turn exerts a force on the first side 35. The position and shape of the connecting members 38, 39 allow for most of the force to be supported by the main body 30, while minimizing the force of the device 20 and any tools held in the device 20 on the clothing pocket.

Having thus described the invention in connection with the preferred embodiments thereof, it will be evident to those skilled in the art that various revisions can be made to the preferred embodiments described herein with out departing from the spirit and scope of the invention. It is my intention, however, that all such revisions and modifications that are evident to those skilled in the art will be included with in the scope of the following claims.

What is claimed is:

1. A tool holder device, comprising:
a main body;
the main body having a first side and a second side;
an extension member attached to the second side;
the extension member comprising a plurality of compartments configured to hold tools such as hammers;
wherein the main body is configured to be selectively inserted into a standard pocket of a user's clothing;
wherein when the main body is in the user's clothing, the tool holder device is in a first position;
a first connecting member connects the first side of the main body to the second side of the main body;
a top of the first side is above a top of the second side when the tool holder device is in the first position;
the first connecting member connects the top of the first side to the top of the second side;
the extension member is attached at or near the top of the second side;
a second connecting member connects the first side of the main body to the second side of the main body;
a main body compartment defined by the first side of the main body, the second side of the main body, and the connecting members;
wherein the main body compartment is configured to hold additional tools.

2. The tool holder device of claim 1, further comprising:
a bottom wall of the main body compartment.

* * * * *